US007322873B2

(12) United States Patent
Rosen et al.

(10) Patent No.: US 7,322,873 B2
(45) Date of Patent: Jan. 29, 2008

(54) ILLUMINATED, THREE-DIMENSIONAL MODULES WITH COAXIAL MAGNETIC CONNECTORS FOR A TOY CONSTRUCTION KIT

(75) Inventors: Lawrence I. Rosen, Mendham, NJ (US); Parvis Daftari, Summit, NJ (US)

(73) Assignee: MEGA Brands America, Inc., Livingston, NJ (US)

( * ) Notice: Subject to any disclaimer, the term of this patent is extended or adjusted under 35 U.S.C. 154(b) by 125 days.

(21) Appl. No.: 11/251,801

(22) Filed: Oct. 18, 2005

(65) Prior Publication Data

US 2006/0134978 A1 Jun. 22, 2006

Related U.S. Application Data

(60) Provisional application No. 60/620,259, filed on Oct. 19, 2004.

(51) Int. Cl.
*A63H 33/04* (2006.01)

(52) U.S. Cl. ..... 446/91; 446/92; 446/124; 446/485

(58) Field of Classification Search ..... 446/91, 446/92, 124, 126, 484, 485; 362/217, 220, 362/225, 260
See application file for complete search history.

(56) References Cited

U.S. PATENT DOCUMENTS

| | | | |
|---|---|---|---|
| 242,821 | A | 6/1881 | Farmer |
| 1,236,234 | A | 8/1917 | Troje |
| 1,535,035 | A | 4/1925 | Philipp |
| 2,448,692 | A | 9/1948 | Teetor |
| 2,570,625 | A | 10/1951 | Zimmerman et al. |
| 2,795,893 | A | 6/1957 | Vayo |
| 2,846,809 | A | 8/1958 | Majewski |
| 2,872,754 | A | 2/1959 | Cronberger |
| 2,939,243 | A | 6/1960 | Duggar |
| 2,970,388 | A | 2/1961 | Yonkers |
| 2,983,071 | A | 5/1961 | Oliver |

(Continued)

FOREIGN PATENT DOCUMENTS

| | | |
|---|---|---|
| DE | 31 52 024 | 7/1983 |

(Continued)

OTHER PUBLICATIONS

German Office Action, Jun. 27, 2002.

(Continued)

*Primary Examiner*—John A. Ricci
(74) *Attorney, Agent, or Firm*—Michael Bednarek; Paul, Hastings, Janofsky & Walker LLP

(57) ABSTRACT

A construction kit that is suitable for creating a variety of different structures includes a plurality of illuminated elements. Each illuminated element has a light source and is electrically conductive. Tin one embodiment, the kit includes a plurality of connectors for linking the plurality of illuminated elements mechanically and electrically to form an illuminated structure, each connector having at least two apertures and being electrically conductive. The kit can include a power supply for supplying power to one connector of the plurality of connectors, wherein the power is transferred from the one connector to each of the plurality of illuminated elements and each of the remaining plurality of connectors, thereby illuminating the structure.

19 Claims, 16 Drawing Sheets

U.S. PATENT DOCUMENTS

| | | | | | |
|---|---|---|---|---|---|
| 3,077,696 | A | | 2/1963 | Barnett et al. | |
| 3,095,668 | A | | 7/1963 | Dorsett | |
| 3,184,882 | A | | 5/1965 | Vega | |
| 3,196,579 | A | | 7/1965 | Lepper | |
| 3,254,440 | A | | 6/1966 | Duggar | |
| 3,447,249 | A | * | 6/1969 | Greger | 434/224 |
| 3,458,949 | A | | 8/1969 | Young | |
| 3,484,984 | A | * | 12/1969 | Fischer | 446/91 |
| 3,594,924 | A | | 7/1971 | Baker | |
| 3,601,921 | A | | 8/1971 | Strohmaier | |
| 3,606,333 | A | | 9/1971 | Green | |
| 3,655,201 | A | | 4/1972 | Nichols | |
| 3,696,548 | A | | 10/1972 | Teller | |
| 3,706,158 | A | | 12/1972 | Jensen | |
| 3,906,658 | A | | 9/1975 | Gross | |
| 3,998,003 | A | | 12/1976 | Rosenbaum | |
| 3,998,004 | A | | 12/1976 | Ehrlich | |
| 4,020,566 | A | | 5/1977 | Dreiding | |
| 4,026,086 | A | | 5/1977 | Langley | |
| 4,118,888 | A | | 10/1978 | Ogawa | |
| 4,238,905 | A | | 12/1980 | MacGraw, II | |
| 4,258,479 | A | | 3/1981 | Roane | |
| D264,694 | S | | 6/1982 | Takahashi | |
| 4,334,870 | A | | 6/1982 | Roane | |
| 4,334,871 | A | | 6/1982 | Roane | |
| 4,364,196 | A | | 12/1982 | Shacket | |
| 4,462,596 | A | | 7/1984 | Yamamoto | |
| 4,509,929 | A | | 4/1985 | Zawitz | |
| 4,513,970 | A | | 4/1985 | Opresco et al. | |
| 4,629,192 | A | | 12/1986 | Nichols | |
| 4,650,424 | A | | 3/1987 | Mitchell | |
| 4,722,712 | A | | 2/1988 | McKenna | |
| 4,741,534 | A | | 5/1988 | Rogahn | |
| 4,836,787 | A | | 6/1989 | Boo | |
| 4,886,273 | A | | 12/1989 | Unger | |
| 5,009,625 | A | | 4/1991 | Longuet-Higgins | |
| 5,021,021 | A | | 6/1991 | Ballard | |
| 5,088,951 | A | * | 2/1992 | Majurinen | 446/91 |
| 5,127,652 | A | | 7/1992 | Unger | |
| 5,347,253 | A | | 9/1994 | Ogikubo | |
| 5,409,236 | A | | 4/1995 | Therrien | |
| 5,411,262 | A | | 5/1995 | Smith | |
| 5,458,522 | A | | 10/1995 | Brooks, III | |
| 5,487,691 | A | | 1/1996 | Chiu | |
| 5,520,396 | A | | 5/1996 | Therrien | |
| 5,545,070 | A | | 8/1996 | Liu | |
| 5,643,038 | A | | 7/1997 | Olsen et al. | |
| 5,651,715 | A | | 7/1997 | Shedelbower | |
| 5,743,786 | A | | 4/1998 | Lindsey | |
| 5,746,638 | A | | 5/1998 | Shiraishi | |
| 5,751,117 | A | * | 5/1998 | Abbott | 315/244 |
| 5,785,529 | A | | 7/1998 | Hearn et al. | |
| 5,826,872 | A | | 10/1998 | Hall | |
| 5,833,465 | A | | 11/1998 | Jarzewiak | |
| 5,848,926 | A | | 12/1998 | Jardetzky et al. | |
| 5,873,206 | A | | 2/1999 | Roberts | |
| 5,904,415 | A | * | 5/1999 | Robertson et al. | 362/260 |
| 6,017,220 | A | | 1/2000 | Snelson | |
| 6,024,626 | A | | 2/2000 | Mendelsohn | |
| 6,062,937 | A | * | 5/2000 | Kikuchi | 446/91 |
| 6,090,431 | A | | 7/2000 | Franklin et al. | |
| 6,116,981 | A | | 9/2000 | Zheng | |
| 6,158,740 | A | | 12/2000 | Hall | |
| 6,241,249 | B1 | | 6/2001 | Wang | |
| 6,256,914 | B1 | | 7/2001 | Yeh | |
| 6,277,428 | B1 | | 8/2001 | Franklin et al. | |
| 6,280,282 | B1 | | 8/2001 | Puchalski | |
| 6,386,540 | B1 | | 5/2002 | Stevkovski | |
| 6,431,936 | B1 | | 8/2002 | Kiribuchi | |
| 6,491,563 | B1 | | 12/2002 | Bailey | |
| 6,566,992 | B1 | | 5/2003 | Vicentelli | |
| 6,626,727 | B2 | | 9/2003 | Balanchi | |
| 6,749,480 | B1 | | 6/2004 | Hunts | |
| 6,805,605 | B2 | * | 10/2004 | Reining et al. | 446/91 |
| 6,846,216 | B1 | | 1/2005 | Balanchi | |
| 6,963,261 | B2 | | 11/2005 | Vicentelli | |
| 6,969,294 | B2 | | 11/2005 | Vicentelli | |
| 2002/0115373 | A1 | | 8/2002 | Lazerman | |
| 2002/0135125 | A1 | | 9/2002 | Wu | |
| 2002/0167127 | A1 | | 11/2002 | Fang | |
| 2004/0018473 | A1 | | 1/2004 | Tusacciu | |
| 2004/0063380 | A1 | | 4/2004 | Chi et al. | |

FOREIGN PATENT DOCUMENTS

| | | |
|---|---|---|
| DE | 33 23 489 | 1/1984 |
| DE | 39 10 304 | 10/1990 |
| DE | 102 07 244 | 2/2002 |
| DE | 202 02 183 | 2/2002 |
| FR | 2 153 792 | 9/1971 |
| FR | 2 301 279 | 2/1975 |
| GB | 2 123 306 | 2/1984 |
| JP | 2001-173889 | 6/2001 |
| WO | WO 89/10604 | 11/1989 |
| WO | WO 99/60583 | 11/1999 |
| WO | WO 02/055168 | 7/2002 |
| WO | WO 02/076565 | 10/2002 |

OTHER PUBLICATIONS

International Search Report, Apr. 14, 2003.

Magna-Tiles Instruction Booklet, date unknown.

Gorbert, Matthew G., Orth, Maggie, and Ishii, Hiroshi, *Triangles: Tangible Interface for Manipulation and Exploration of Digital Information Topography*, Proceedings CH1/98, Apr. 18-23, 1998, pp. 49-56, CHI 98.

* cited by examiner

ILLUMINATED, THREE-DIMENSIONAL MODULES WITH COAXIAL MAGNETIC CONNECTORS FOR A TOY CONSTRUCTION KIT

This application claims the benefit of U.S. Provisional Application No. 60/620,259, filed Oct. 19, 2004, which is herein incorporated by reference in its entirety.

BACKGROUND

1. Field of the Invention

The present invention is directed generally to puzzles and toys. More particularly, the present invention is directed to construction toys for building stable three-dimensional structures utilizing various construction elements, at least some of which have luminescent characteristics.

2. Background of the Invention

Individuals often find enjoyment in the challenge of building aesthetic structural designs and/or functional structural models. Frequently, the utility associated with constructing such structures is found in the creative and/or problem-solving process required to achieve a desired structural objective. Currently, construction assemblies that exploit magnetic properties to interlink various structural components and thereby form different three-dimensional structures are known and can provide an added dimension of sophistication to the construction process. Examples of such construction assemblies include the magnetic construction toy disclosed in Balanchi U.S. Pat. No. 6,626,727, the modular assemblies disclosed in Vicentielli U.S. Pat. No. 6,566,992, and the magnetic puzzle/toy disclosed in Smith U.S. Pat. No. 5,411,262. In particular, German Patent No. DE 202 02 183 U1 to Kretzschmar describes flat triangles, squares and rectangles used in conjunction with ferromagnetic balls to create a limited range of geometric constructions. The flat shapes disclosed in the Kretzschmar German Patent consist of magnets inserted in the corners of a triangular or square piece, or six magnets in a rectangular plate that can be attracted to steel balls to create a limited number of three-dimensional shapes. Thus, conventional construction kits are appealing to persons of all ages in that they allow for both aesthetic and geometric creativity.

The above-noted magnet construction assemblies each contain a certain number of component parts, which can sometimes limit geometries and stable or secure connections. Thus, a need remains for a magnetic construction assembly that provides more flexibility in both aesthetic and geometric design, and, moreover, that provides an additional degree of design/construction sophistication.

BRIEF SUMMARY OF THE INVENTION

The present invention provides new and improved construction modules that are three-dimensional in shape and have internal light-emitting attributes. In one embodiment of the invention, a construction kit includes a plurality of construction modules. The shapes of the construction modules are those of polyhedrons (e.g., cubes, cylinders, pyramids, prisms, and other shapes) and at least two sides, and in some cases all sides, of such construction modules are equipped with a low-profile coaxial connector for connecting to a complementary low-profile coaxial connector located on a side of a similar construction module. The connections provided by such coaxial connectors include a secure mechanical connection borne of magnetic attraction, as well as a strong electrical connection for DC power transmission to the internal LED light source. One or more of the magnets used for providing the mechanical connection is also employed as a planar electrical contact in the electrical connection. In the case of cube-shaped construction modules in accordance with the present invention, such connections can advantageously be made along all three axial directions and between any two adjacent sides of such construction modules.

The surface of the side on which each such coaxial connector is located features a series of protrusions and cavities arranged in a regular radial array around the periphery of the coaxial connector for mating with a complementary series of protrusions and cavities located on the side an adjacent construction module (i.e., one with which the above-mentioned mechanical and electrical connections have been made). These regular radial arrangements of protrusions and cavities deter lateral slippage between sides of the adjacent construction modules, while providing angular indexing with respect to the mechanical connection. In addition, these arrangements of protrusions and cavities substantially prevent accidental short-circuits from occurring in the electrical connection.

In an alternative embodiment, a construction kit includes a plurality of illuminating construction elements and a plurality of connectors. The construction elements connect to one another (or to construction members that do not illuminate) via connectors. A construction formed by the construction elements is illuminated by a single power supply.

Additional features and advantages of the invention will become apparent with reference to the following detailed description thereof.

BRIEF DESCRIPTION OF THE DRAWINGS

For a more complete understanding of the present invention, reference is made to the following detailed description of various exemplary embodiments thereof, considered in conjunction with the accompanying drawings, in which.

DETAILED DESCRIPTION OF THE INVENTION

In accordance with one embodiment of the present invention, construction modules having three-dimensional shapes, such as that of cubes, cylinders, pyramids, prisms and other shapes, are provided with walls or side panels made of translucent or transparent material and forming an interior chamber, in which is disposed an externally-powered light source for illuminating such modules from within. Each such construction module is sized for easy manipulation and includes a number of externally-directed magnets for use in integrating multiple instances of such modules together. Sturdy, attention-getting constructions may thus be assembled, which can take on any number of forms and/or sizes, and wherein the internal illumination feature of the three-dimensional construction modules provides a wide variety of aesthetically appealing and entertaining lighting options.

In accordance with another embodiment of the present invention, construction elements that illuminate are connected via connectors. Connectors link construction elements mechanically and electrically in a variety of configurations. An external power supply applied to a connector illuminates a structure having at least one connecting element and at least one connector.

Figure 1:
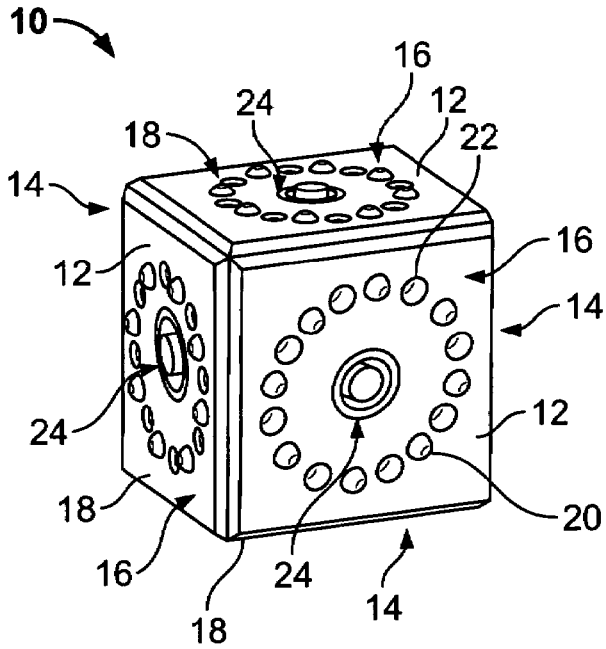
FIG. 1 is a perspective view of a construction module in accordance with a first embodiment of the present invention, wherein the three-dimensional shape thereof is that of a cube.

Referring to FIG. 1, there is shown a construction module 10 configured in accordance with a first embodiment of the present invention, featuring interior lighting and other features to facilitate the assembly of attractive, sturdy constructions. The construction module 10 is three-dimensional and includes six panels made of translucent material and is sized, shaped and configured so as to form a cube. In particular, the construction module 10 includes three panels 12 of a first type, which are shown in FIG. 1 (see also FIG. 2), and three panels 14 (obscured, see also FIG. 5) of a second type. Each of the panels 12, 14 includes a side surface 16, at which is formed a regular array 18 of eight protrusions 20 and eight cavities 22 provided in a circular pattern. The specific construction and function of the array 18 of protrusions and cavities will be described more fully hereinafter. Each of the panels 12 further includes a coaxial connector 24 embedded within the side surface 16. The coaxial connectors 24 are of low profile with respect to their respective side surfaces 16, and are adapted to perform both mechanical and electrical connection functions. The construction and function of the coaxial connectors 24 will be described in further detail hereinafter.

Figure 2:
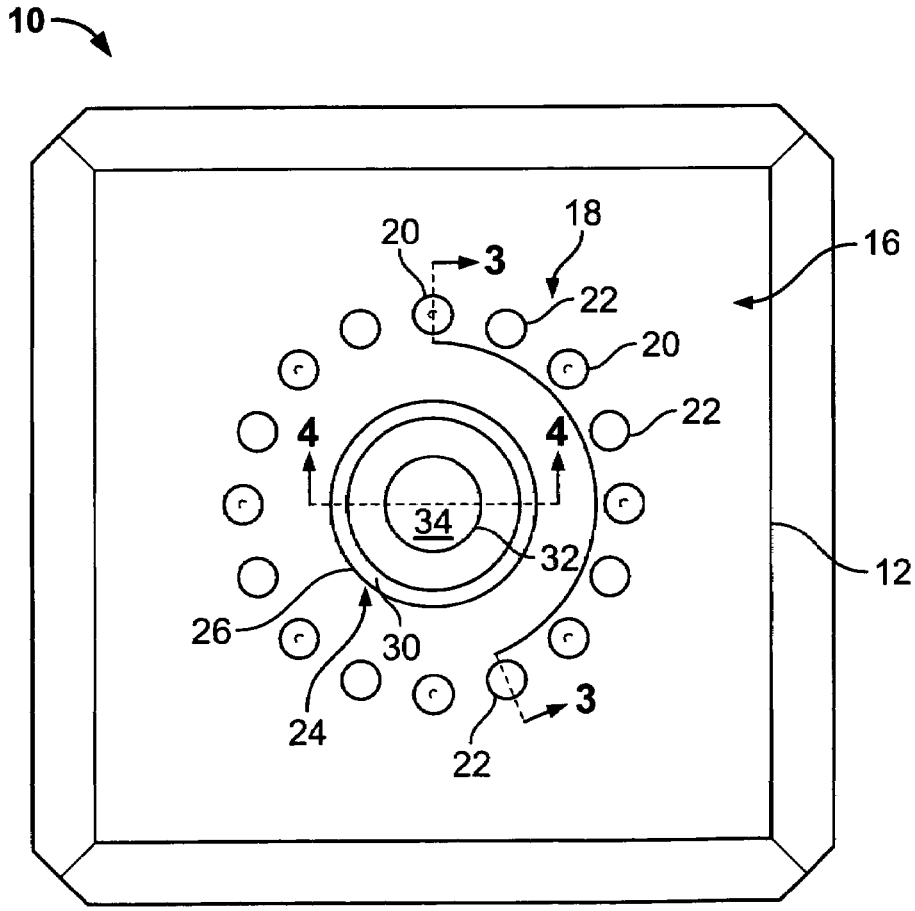
FIG. 2 is an elevational view of the construction module of FIG. 1, showing one of the three side panels thereof, which is visible in the FIG. 1 perspective view.
Figure 3:
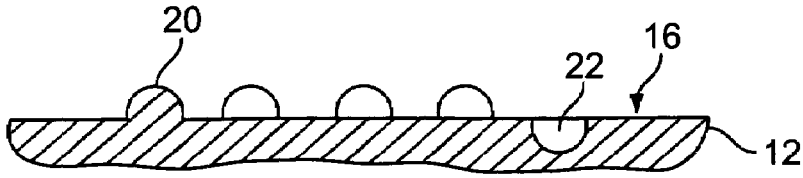
FIG. 3 is a cutaway cross-sectional view of the construction module of FIG. 1, taken along the section line 3-3 shown in FIG. 2.
Figure 4:
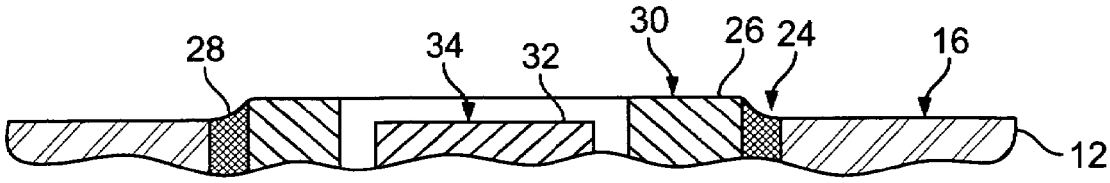
FIG. 4 is a cutaway cross-sectional view of the construction module of FIG. 1, taken along the section line 4-4 shown in FIG. 2.

As shown in FIGS. 2 and 3, the protrusions 20 and cavities 22 on the panels 12 are arranged in a circular, alternating pattern, the function and significance of which will be discussed hereinafter. As shown in FIGS. 2 and 4, the coaxial connector 24 includes a first annular ring 26 of an electrically conductive material, preferably metallic, embedded in the side surface 16 of the panel 12 and attached thereto via a second annular ring 28 consisting of a flexible elastomeric material. The first annular ring 26 extends generally outward from within an interior chamber (not shown) of the construction module 10 formed by the panels 12, 14 of the construction module 10 (FIG. 1), and includes a conductive surface 30 which is substantially flat. The first annular ring 26 is movable with respect to the panel 12 because of the flexible nature of the annular ring 28. Ordinarily, however (i.e., when not subjected to significant external force), the conductive surface 30 is disposed slightly above the side surface 16 of the panel 12. The structure and function of the first annular rings 26, 28 will be discussed in greater detail hereinafter.

As also shown in the FIGS. 2 and 4, the coaxial connector 24 includes a projection 32 of a material that is both electrically conductive and magnetic. The projection 32 is centrally disposed within the annular ring 26, and extends outwardly from within the interior chamber (not shown) of the construction module 10. The projection 32 includes an outward-facing surface 34, which is conductive, magnetic, and substantially flat. The position and orientation of the projection 32 with respect to the panel 12 is substantially fixed such that the outward-facing surface 34 remains substantially coplanar with the side surface 16 of the panel 12. The structure and function of the projection 32 will be discussed in greater detail hereinafter.

Figure 5:
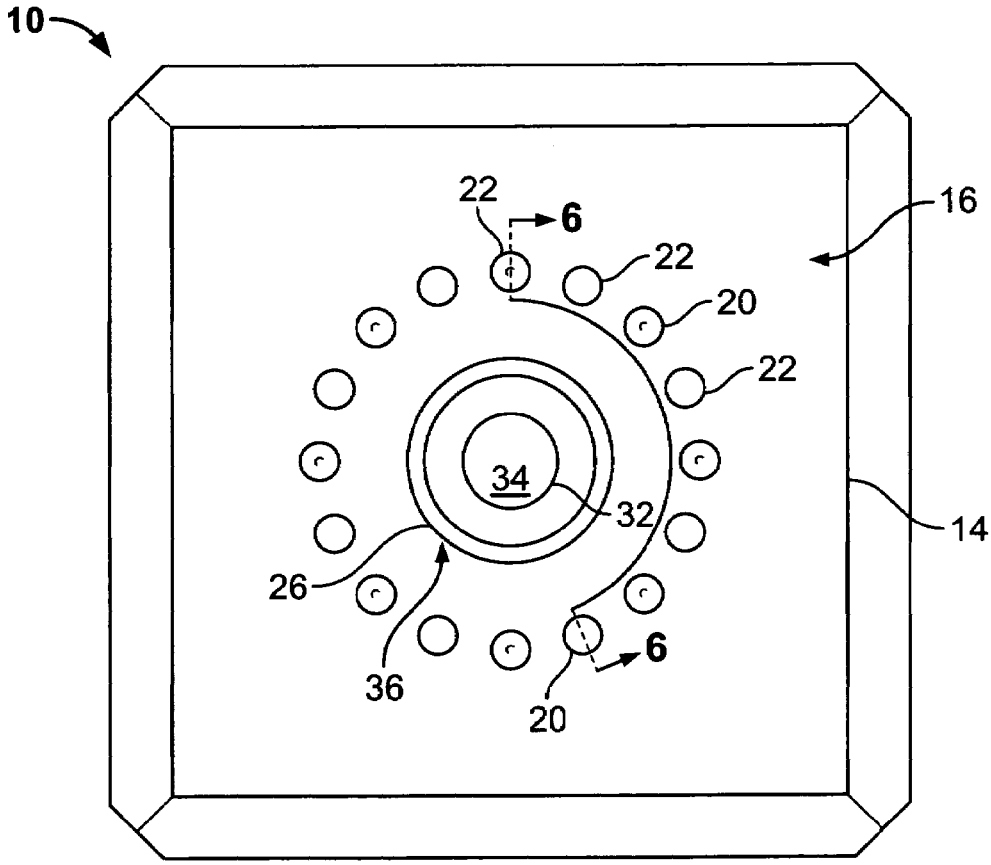
FIG. 5 is an elevational view of the construction module of FIG. 1, showing one of the three side panels thereof, which is obscured in the FIG. 1 perspective view.
Figure 6:
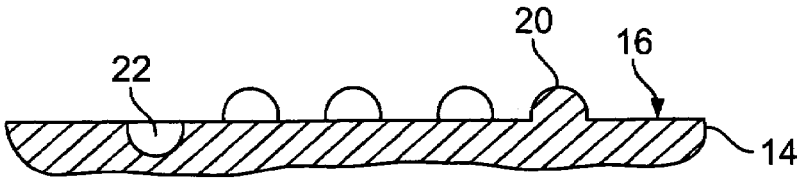
FIG. 6 is a cutaway cross-sectional view of the construction module of FIG. 1, taken along the section line 6-6 shown in FIG. 5.

As shown in FIGS. 5 and 6, the protrusions 20 and cavities 22 on the panels 14 are also arranged in a circular, alternating pattern. As may be seen by comparing FIG. 5 to FIG. 2, the pattern of the arrays 18 on the panels 14 is rotated slightly (e.g., by 22½ degrees) with respect to the side surfaces 16 so that, as compared to the arrays 18 on the panels 12, the relative positions of the protrusions 20 and cavities 22 are interchanged.

As shown in the FIG. 5, the panels 14 include coaxial connectors 36 similar to the coaxial connectors 24 of the panels 12, with the following difference. The polarity of the magnetic surface 34 of the projection 32 of the coaxial connectors 36 is the reverse of the polarity of the magnetic surface 34 of the projection 32 of the coaxial connectors 24, such that the former and the latter are magnetically attracted to each other.

Figure 7:
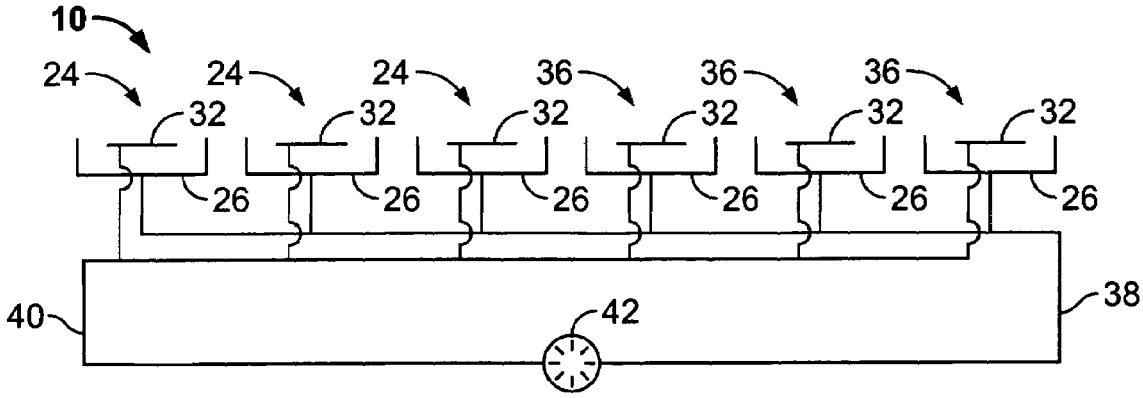
FIG. 7 is a schematic view illustrating the internal and external electrical components of the construction module of FIG. 1.

Referring to FIG. 7, the construction module 10 includes interior conductors 38, 40, by which the annular rings 26 and the projections 32, respectively, of the coaxial connectors 24, 36 are made electrically common. Further included within the interior chamber (not shown) of the construction module 10 is an LED light source 42 electrically disposed between the annular rings 26 and the projections 32 for receiving power via one or more of the coaxial connectors 24, 36 and illuminating the construction module 10 from within. The electrical function of the construction module 10 will be explained further hereinafter.

Figure 8:
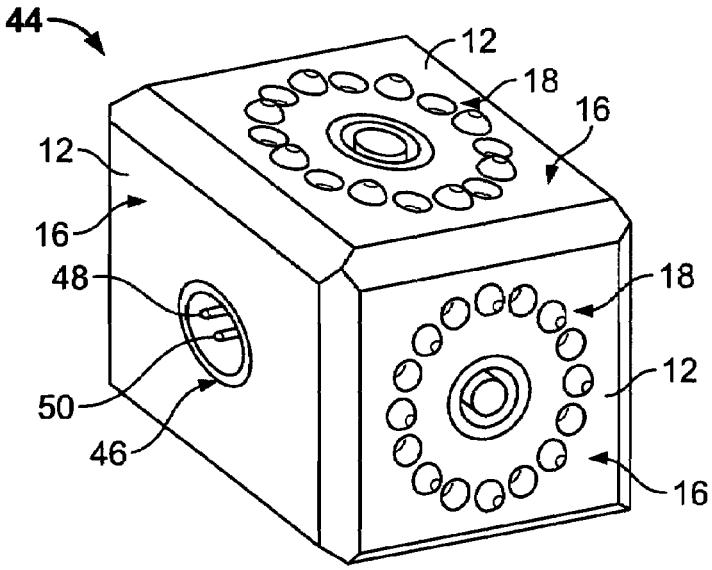
FIG. 8 is a perspective view of another construction module constructed in accordance with an alternative embodiment of the present invention, wherein the three-dimensional shape thereof is that of a cube.
Figure 9:
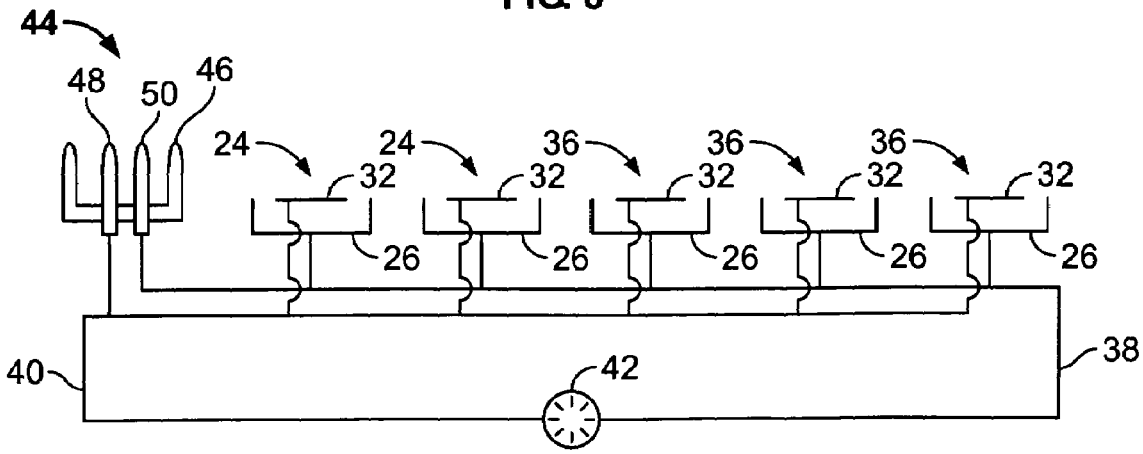
FIG. 9 is a schematic view illustrating the internal and external electrical components of the construction module of FIG. 8.

Another example of a construction module in accordance with the present invention is illustrated in FIGS. 8 and 9. Referring to FIG. 8, a construction module 44 is illustrated, which is similar in all respects to the construction module 10 described hereinabove with reference to FIGS. 1-7, with the following differences. One of the first-type panels 12 of the construction module 44 lacks both an array 18 of protrusions and cavities formed along the side surface 16, and a coaxial connector 24 embedded in the side surface 16, and is equipped instead with a female receptacle 46 of conventional construction and having respective positive and negative contacts 48, 50 for receiving low-voltage DC power from an external source. The function of the construction module 44 will be explained further hereinafter.

Figure 10A:
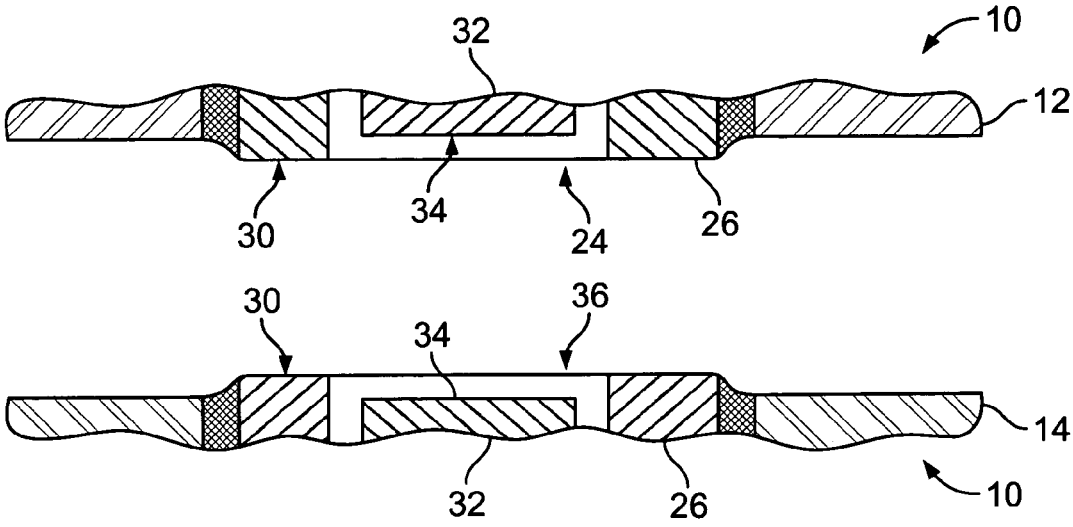
FIGS. 10*a*-10*c* and 11*a*-11*b* illustrate steps in the process of mechanically and electrically mating two construction modules, each of which is constructed in accordance with the embodiment of FIG. 1.
Figure 10B:
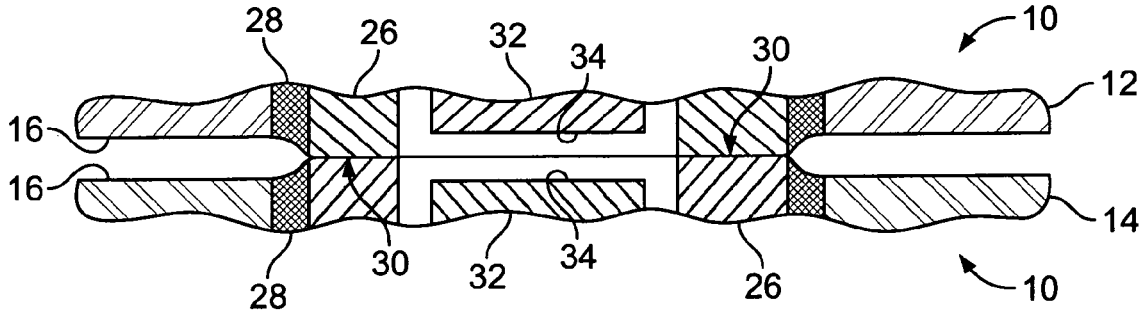
Figure 10C:
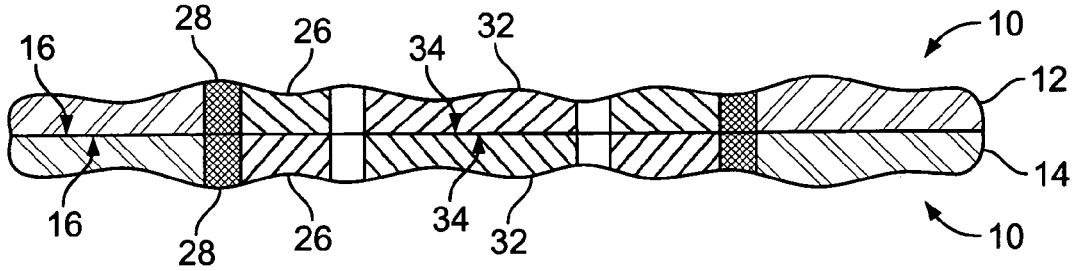

In use, several construction modules 10 can be combined with a construction module 44 in an attractive construction featuring internal lighting and sturdy construction for aesthetic pleasure and/or as a leisure time recreational activity that fosters creativity and stimulates mental development. As shown in FIGS. 10*a*-10*c*, to combine two construction modules 10 (and/or to combine a construction module 10 and a construction module 44), the coaxial connector 24 of a panel 12 of one construction module 10 is attached to the coaxial connector 36 of a panel 14 of the other construction module 10.

Referring to FIG. 10*a*, this module mating process begins by vertically aligning the coaxial connectors 24, 36 so that the conductive surfaces 30 of the respective first annular rings 26 face each other, and the conductive, magnetic surfaces 34 of the respective projections 32 face each other. Next, the construction modules 10 are brought together so that mechanical and electrical contact is established between the first annular rings 26 at their respective conductive surfaces 30, as shown in FIG. 10*b*. Next, because the conductive, magnetic surfaces 34 are now in close enough proximity to exert force on the respective conductive blocks 10, the first annular rings 26 are urged toward their respective panels 12, 14. The force applied thereby against the first annular rings 26 causes the second annular rings 28, already in contact, to deflect. This causes the first annular rings 26 to move into their respective panels 12, 14 enough to permit mechanical and electrical contact to be established between the respective magnetic, conductive surfaces 34 of the projections 32. Further, the side surfaces 16 of the panels 12, 14 are also thereby brought into substantial planar contact, since the side surfaces 16 and the magnetic conductive surfaces 34 are substantially coplanar.

Figure 11A:
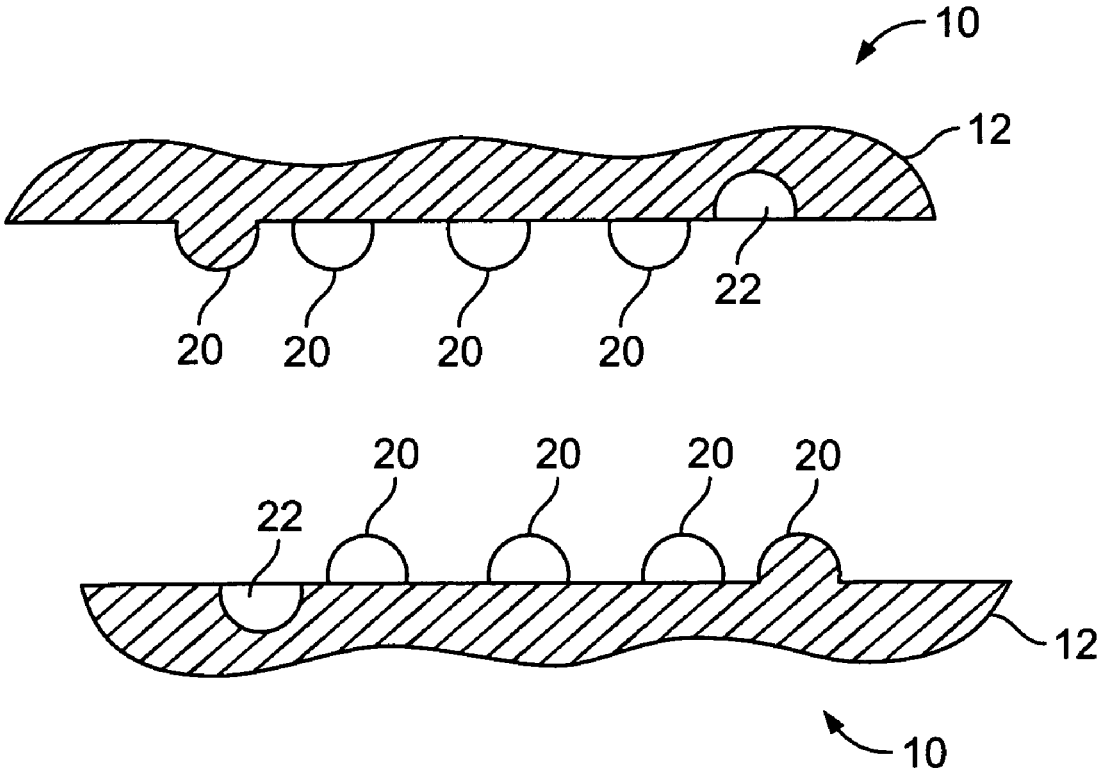
Figure 11B:
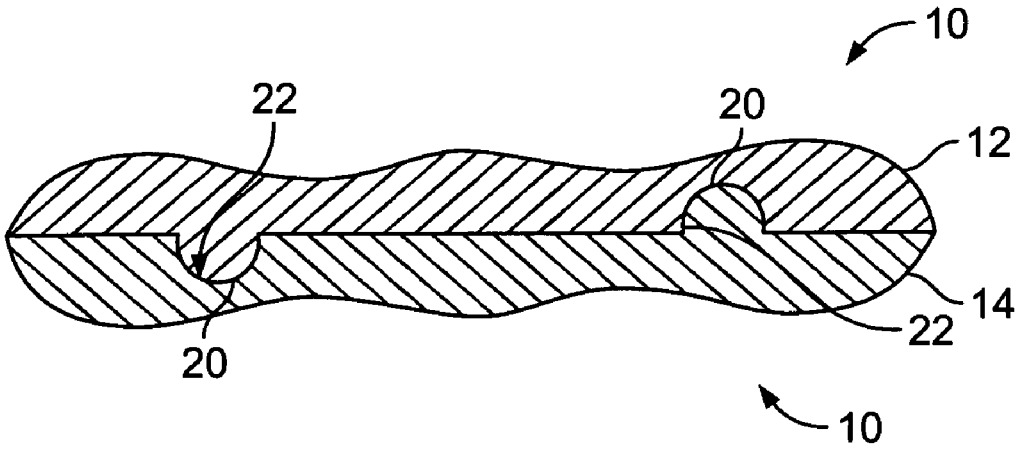

Referring to FIGS. 11*a*-11*b*, the module mating process also includes the step of aligning respective projections 20 and cavities 22 of the panels 12, 14 (see FIG. 11*a*) so that corresponding instances of the former pass into the latter (see FIG. 11*b*) to permit the aforementioned electrical connections to be established. As may be seen with reference to FIGS. 2 and 5, the respective arrays 18 of projections and cavities 22 provide flexibility with respect to the existence of and degree of relative rotation between two construction modules 10 being assembled together. For example, two construction modules can be assembled so that the angle between adjacent sides is zero degrees, 22.5 degrees, 45 degrees, or any other number of degrees appropriate, via an angular indexing function inherent in the complementary arrays of "satellite"-type features that "orbit" around the respective coaxial connectors 24, 36. It should be noted that the protrusions 20 of the panels 12 and 14 form a fail-safe connection, which essentially prevents short-circuits from occurring between surfaces of the first annular rings 26 and the projections 32 not intended to be brought into electrical contact with each other.

Figure 12:
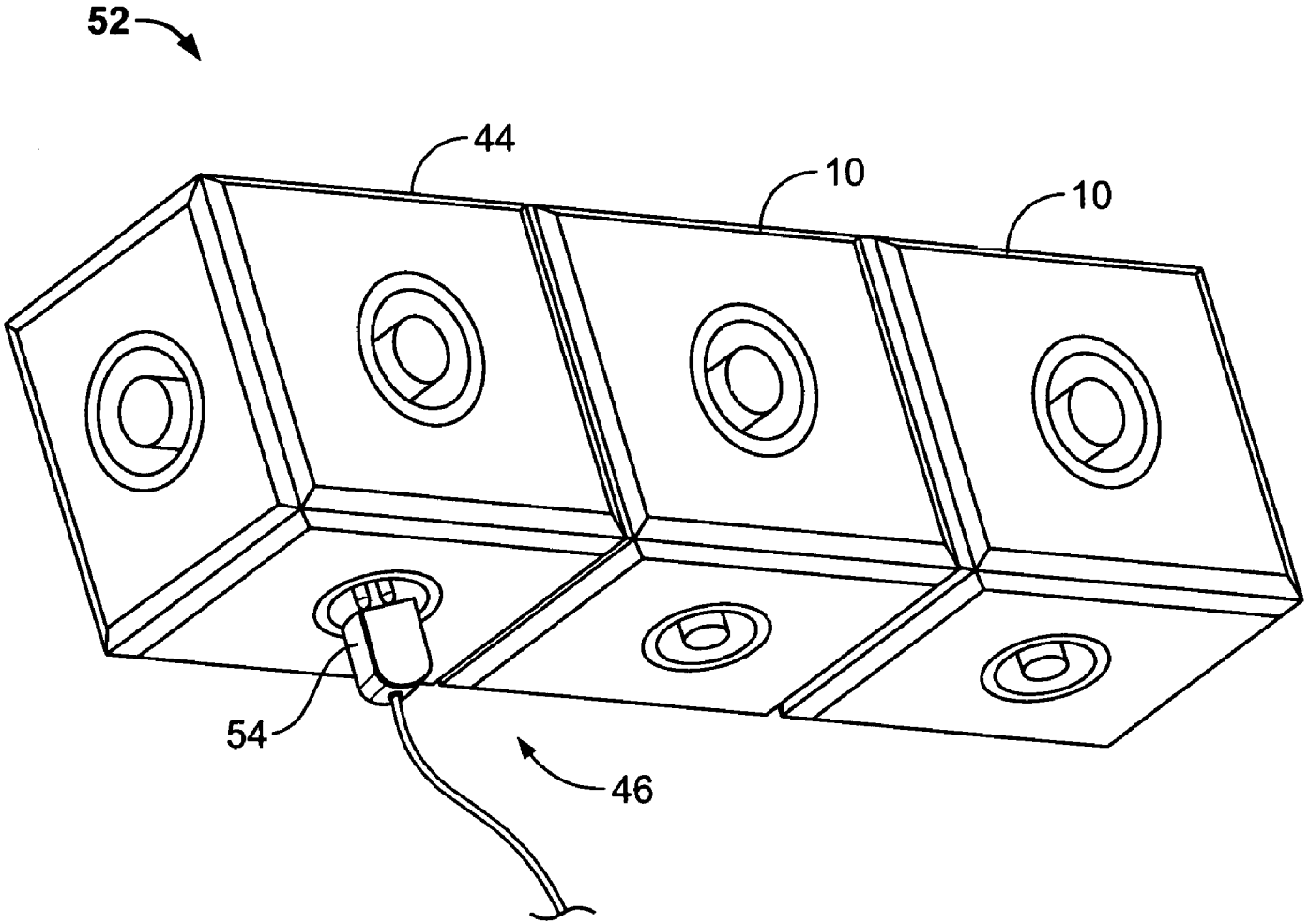
FIG. 12 is a perspective view of construction formed by combining the construction module of FIG. 8 with a plurality of modules constructed in accordance with the embodiment of FIG. 1.
Figure 13:
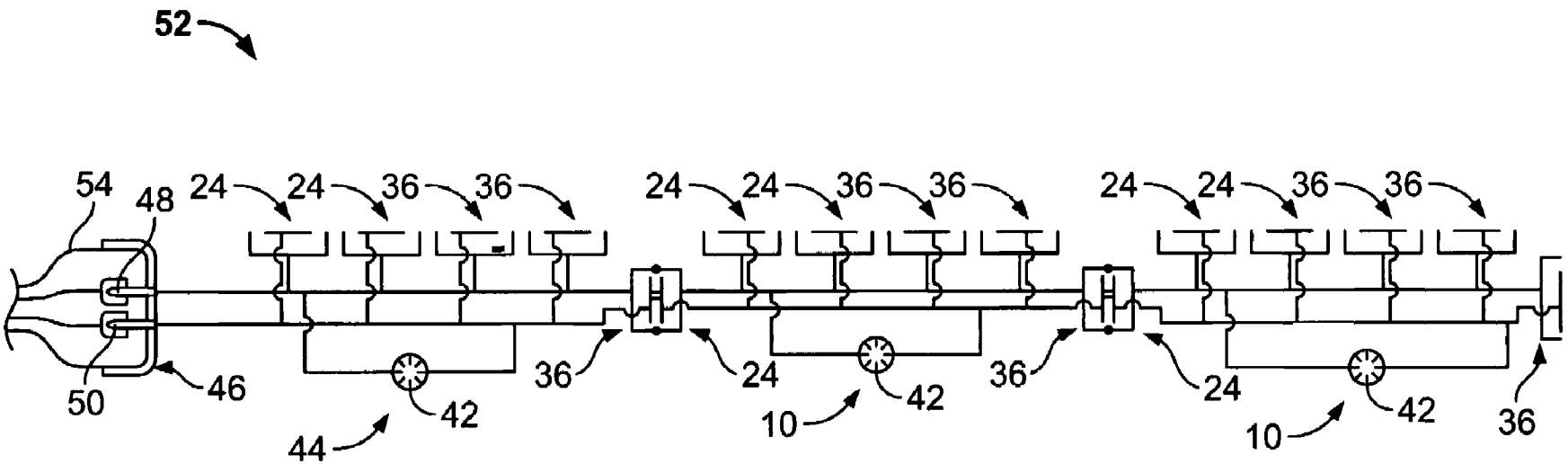
FIG. 13 is a schematic view illustrating the interconnection between the electrical components of the construction modules comprising the construction of FIG. 12.

As shown in FIGS. 12 and 13, a construction 52 may be assembled using the above-described process by combining a construction module 44 with a plurality of construction modules 10. In the particular construction 52 shown in FIGS. 12 and 13, two construction modules 10 are assembled in a straight line from the construction module 44, and a power cord 54 connected to a low-voltage DC power source (not shown) is mated with female connector 46 of the construction module 44 to provide power for illuminating the LED light sources 42 (FIGS. 7 and 9) of the modules. Although shown herein as an LED light source, the skilled artisan will appreciate that any type of light source can be used, including, but not limited to, an electro luminescent, LED or miniature incandescent light source.

Figure 14:
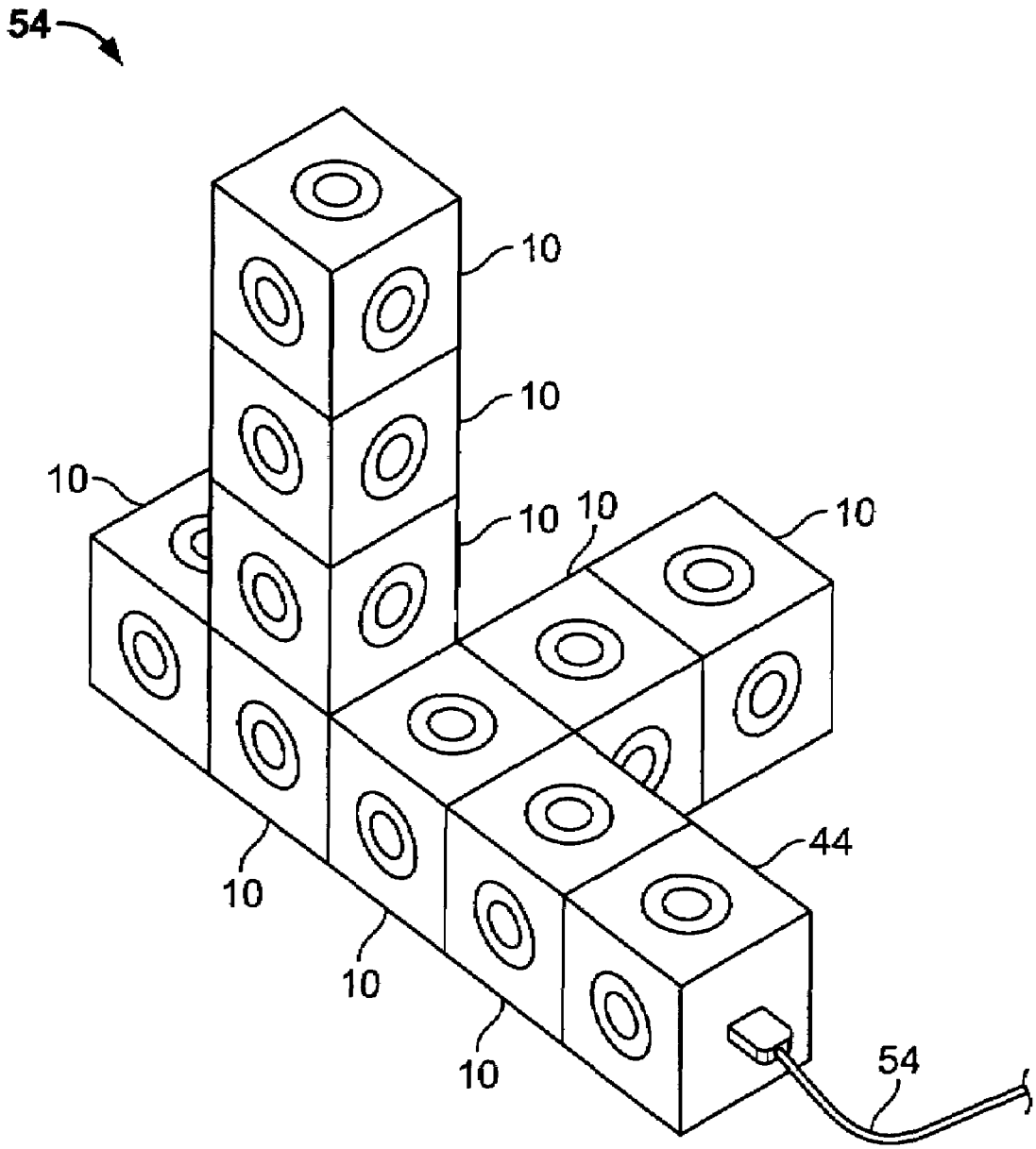
FIG. 14 is a perspective view of another construction formed by combining the construction module of FIG. 8 with a plurality of modules constructed in accordance with the embodiment of FIG. 1.
Figure 15:
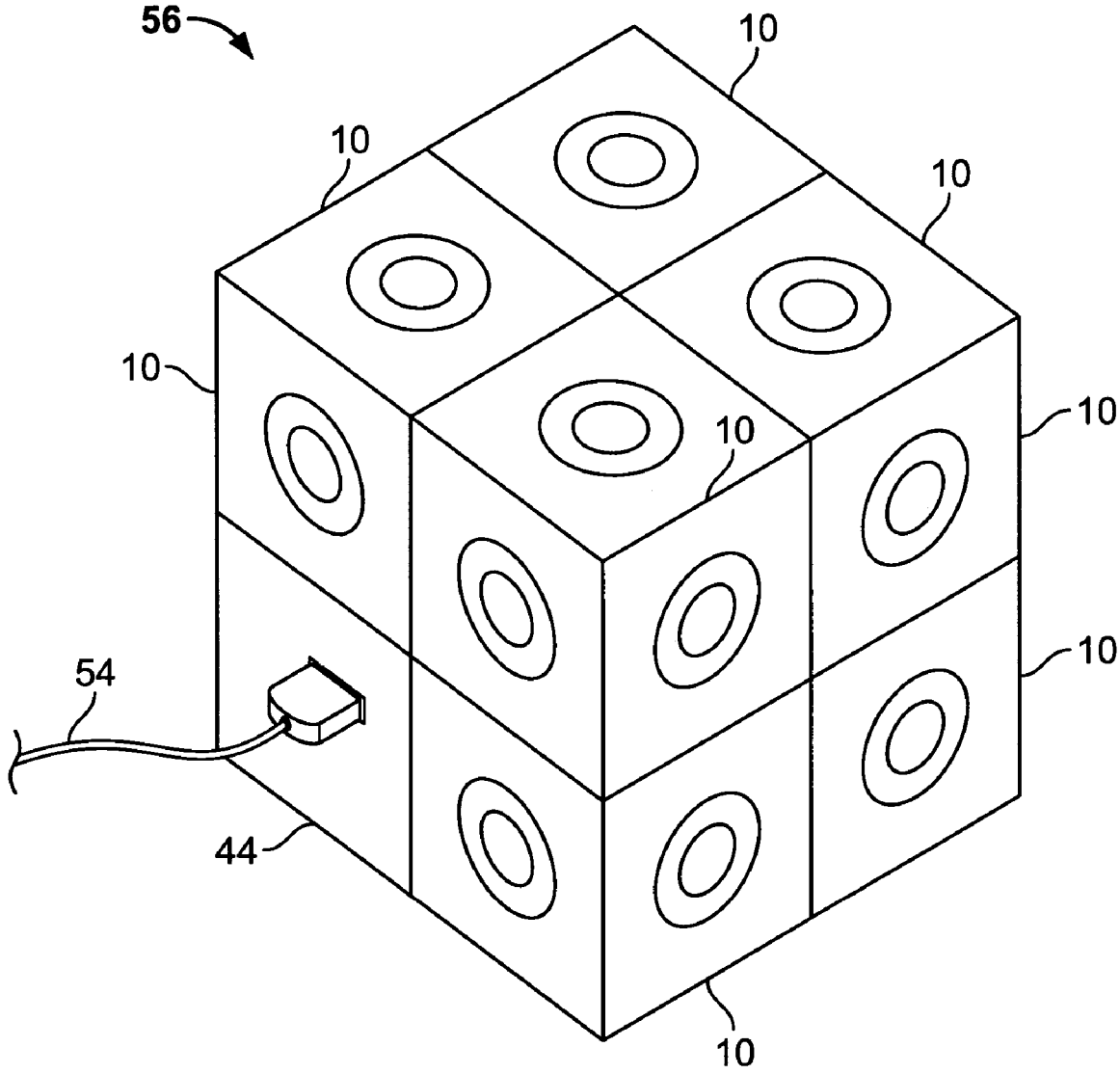
FIG. 15 is a perspective view of yet another construction formed by combining the construction module of FIG. 8 with a plurality of modules constructed in accordance with the embodiment of FIG. 1.

Referring to FIG. 14, a similar construction 54 may be assembled using the above-described process by combining a construction module 44 with a plurality of construction modules 10 assembled in all three axial directions from the construction module 44, and a power cord 54 connected to a low-voltage DC power source (not shown). Referring to FIG. 15, a similar construction 56 may be assembled using the above-described process by combining a construction module 44 with a plurality of construction modules 10 arranged in the form of a block or cluster, and a power cord 54 connected to a low-voltage DC power source.

Numerous benefits are provided by the three-dimensional construction modules 10, 44 and/or by constructions containing such construction modules and built in accordance with the foregoing description. The combination of transparent or translucent panels 12, 14 with interior lighting in a conveniently-sized construction module 10 naturally sparks the imagination to produce constructions (e.g., constructions 52, 54, 56) having one or more of a multiplicity of shapes, lighting colors and/or patterns. Disassembly and reassembly can be accomplished with great speed.

Figure 16:
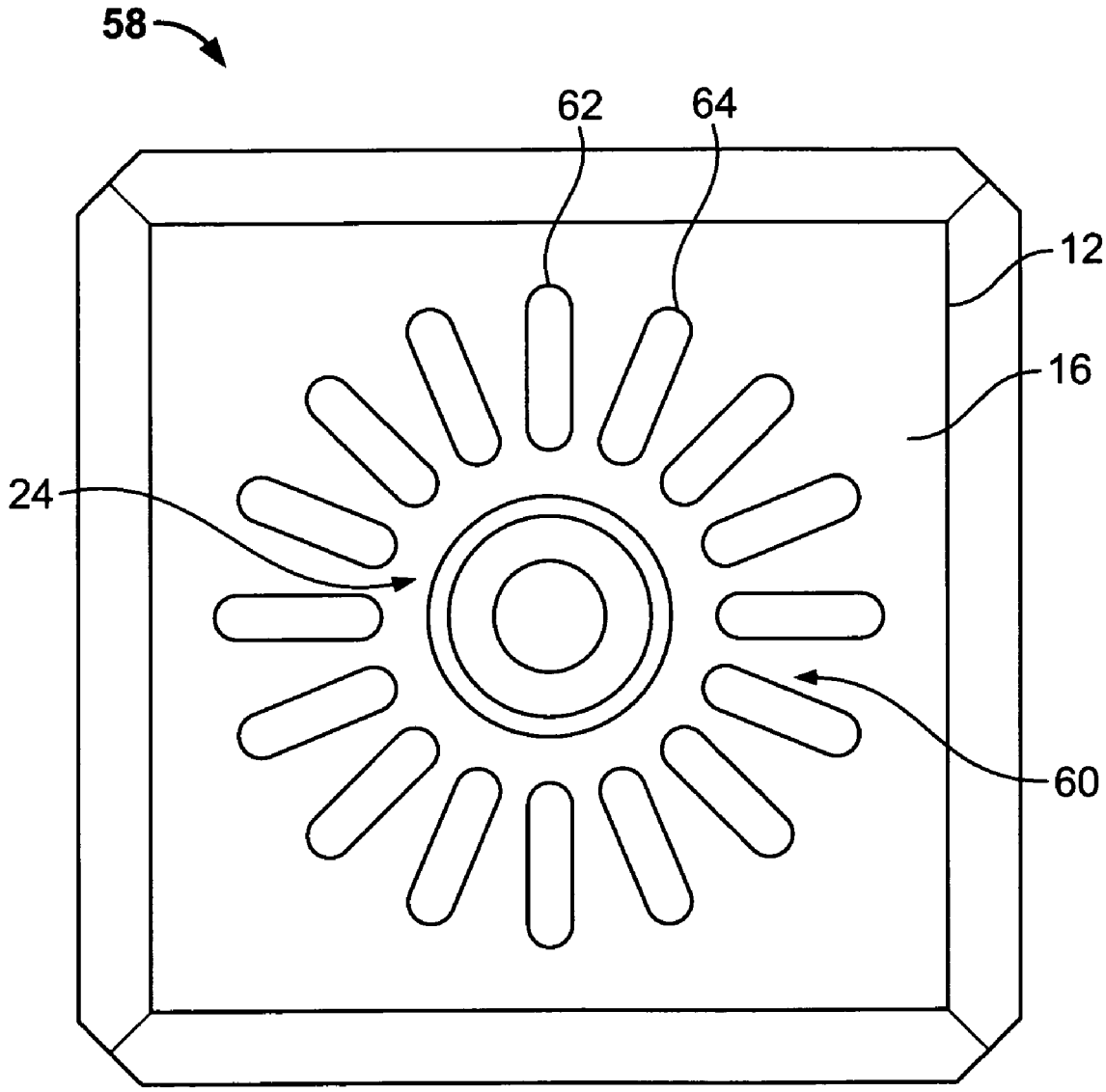
FIG. 16 is an elevational view of a construction module constructed in accordance with yet another embodiment of the present invention.

It should also be noted that the present invention comprehends embodiments in addition to the construction modules 10, 44 of FIGS. 1-8. One such exemplary embodiment is illustrated in the construction module 58 of FIG. 16, which is the same as the construction module 10 of FIG. 1, with the following differences. The regular array 18 of hemispherical protrusions 20 and cavities 22 is replaced with a regular array 60 of radially-extending ridges 62 and channels 64 having semicircular shapes in tangential cross-section. The ridges 62 and channels 64 appear at the same respective radial stations as the protrusions 20 and cavities 22 of the regular array 18 of the construction module 10, and the panels 14 of the construction module 58 feature a similar regular array 60 (not shown) of ridges 62 and channels 64, similarly offset (e.g., by 22½ degrees) for proper mating and alignment. Other complementary shapes and configurations for such protrusions and cavities are possible.

Figure 17:
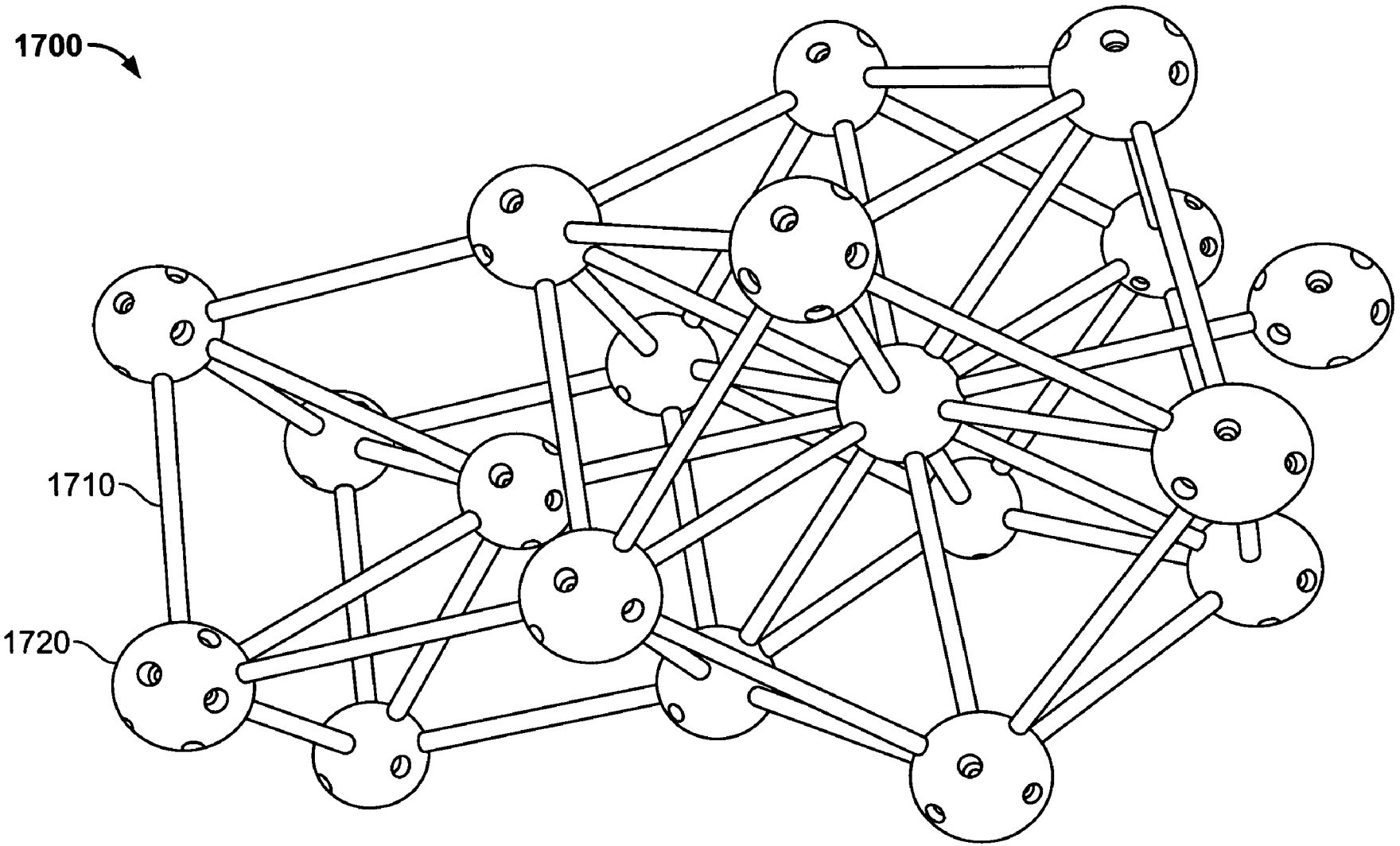
FIG. 17 is a perspective view of a structure formed by combining a plurality of construction elements and connectors in accordance with yet another embodiment of the present invention.

FIG. 17 shows a construction system 1700 constructed in accordance with a fourth embodiment of the present invention. The three-dimensional shape of construction system 1700 includes self-illuminated elements 1710, connectors 1720 and a power source (not shown). Elements 1710 are self-illuminating during assembly and/or after assembly by the use of an electric power supply. The electric power supply is attached to any one of connectors 1720.

Figure 18:
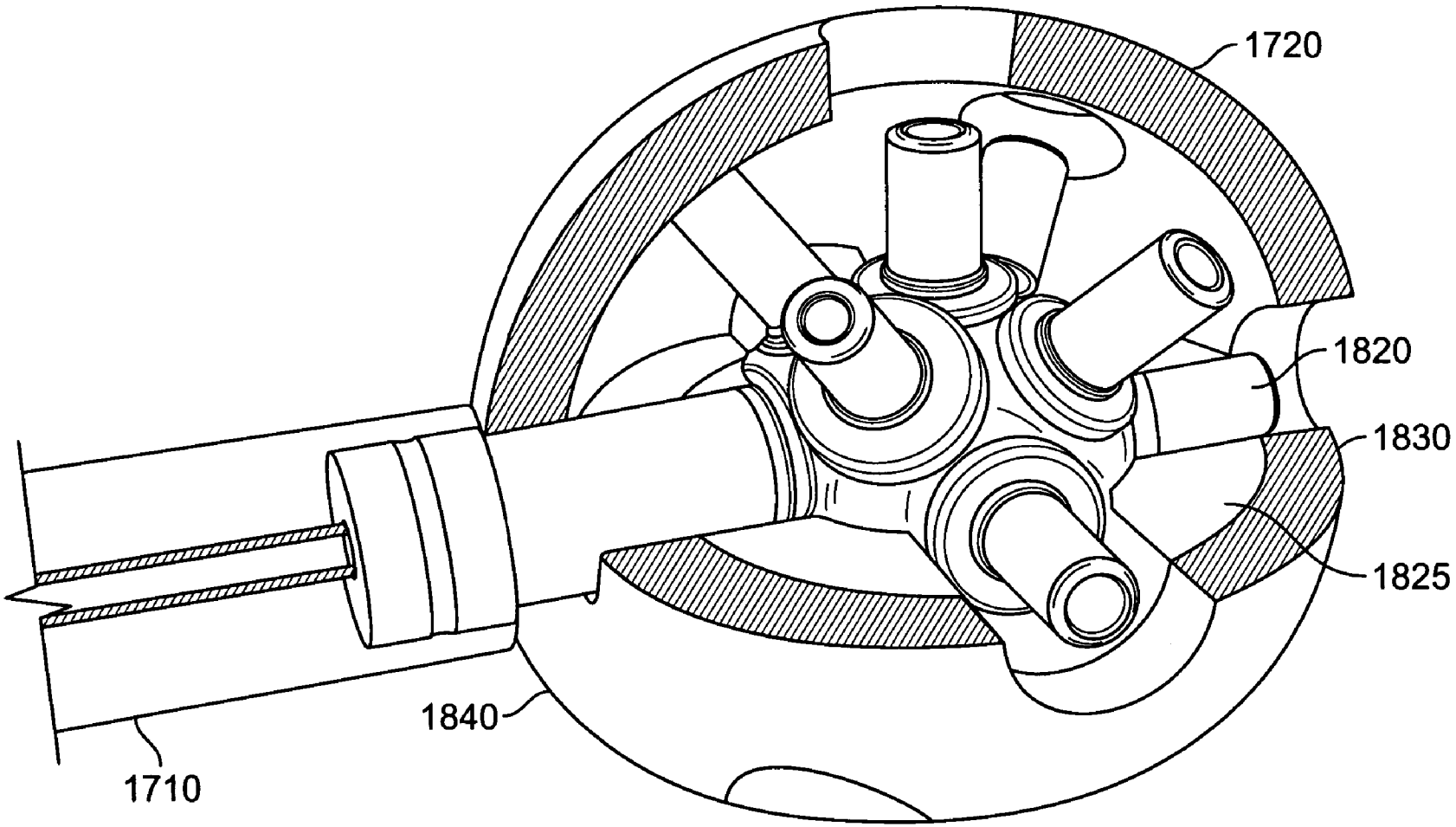
FIG. 18 is a partial interior view of a connector of FIG. 17.

FIG. 18 shows a partial interior view of a connector 1720. Connector 1720 allows the expansion and construction of a construction system 1700. In a preferred embodiment, connector 1720 is a 14-way unit that allows the elements 1710 to connect in any direction. However, simpler connectors can be made for specific applications. For example, a two-dimensional connector may be used to connect elements within two dimensions, such as a straight line, elbows in any angle or "T," and "Y" connectors in any given angle. Similar simple connectors may be used to connect elements within three dimensions, such as a three-dimensional elbow connector at any angle, any three-dimensional "T" or "Y" connectors at any angle, or any three-dimensional crossing connector at any angle.

Connector 1720 links elements 1710 to each other mechanically and electrically. A coaxial connector or plug 1840 of element 1710 is inserted into a complementary coaxial connector at connector 1720, thereby connecting element 1710 mechanically and electrically to connector 1720. As shown herein, connector 1720 comprises female coaxial connectors only, whereas element 1710 comprises male coaxial connectors. However, the skilled artisan will recognize that various configurations of male/female connections are feasible. The axial connectors 1840 have the same functionality described above with reference to FIGS. 2 and 5.

Connector 1720 contains a center conductor 1820 and a perimeter conductor 1830 separated by an insulator 1825. Center conductor 1820 is a conductor, such as a metal, having a surface with a positive magnetic polarity. Similarly, perimeter conductor 1830 is a conductor, such as a metal, having a surface with a negative magnetic polarity. Center conductor 1820 and perimeter conductor 1830 serve to connect to the inner and outer coaxial rings of the coaxial connector plug 1840, respectively. Namely, center conductor 1820 serves as the inner channel of a coaxial cable, which serves as a signal carrier of the signal or current from element 1710, and perimeter conductor 1830 serves as the outer channel of a coaxial cable. In one embodiment, perimeter conductor 1830 is connected to ground. In yet another embodiment, perimeter conductor 1830 is connected to a negative terminal of a DC or an AC power source.

Thus, a charged element 1710 mechanically connected to connector 1720 transfers current via center conductor 1820 to any other element 1710 connected to connector 1720. In this manner, connector 1720 allows element 1710 to share power with other elements linked to connector 1720.

Figure 19:
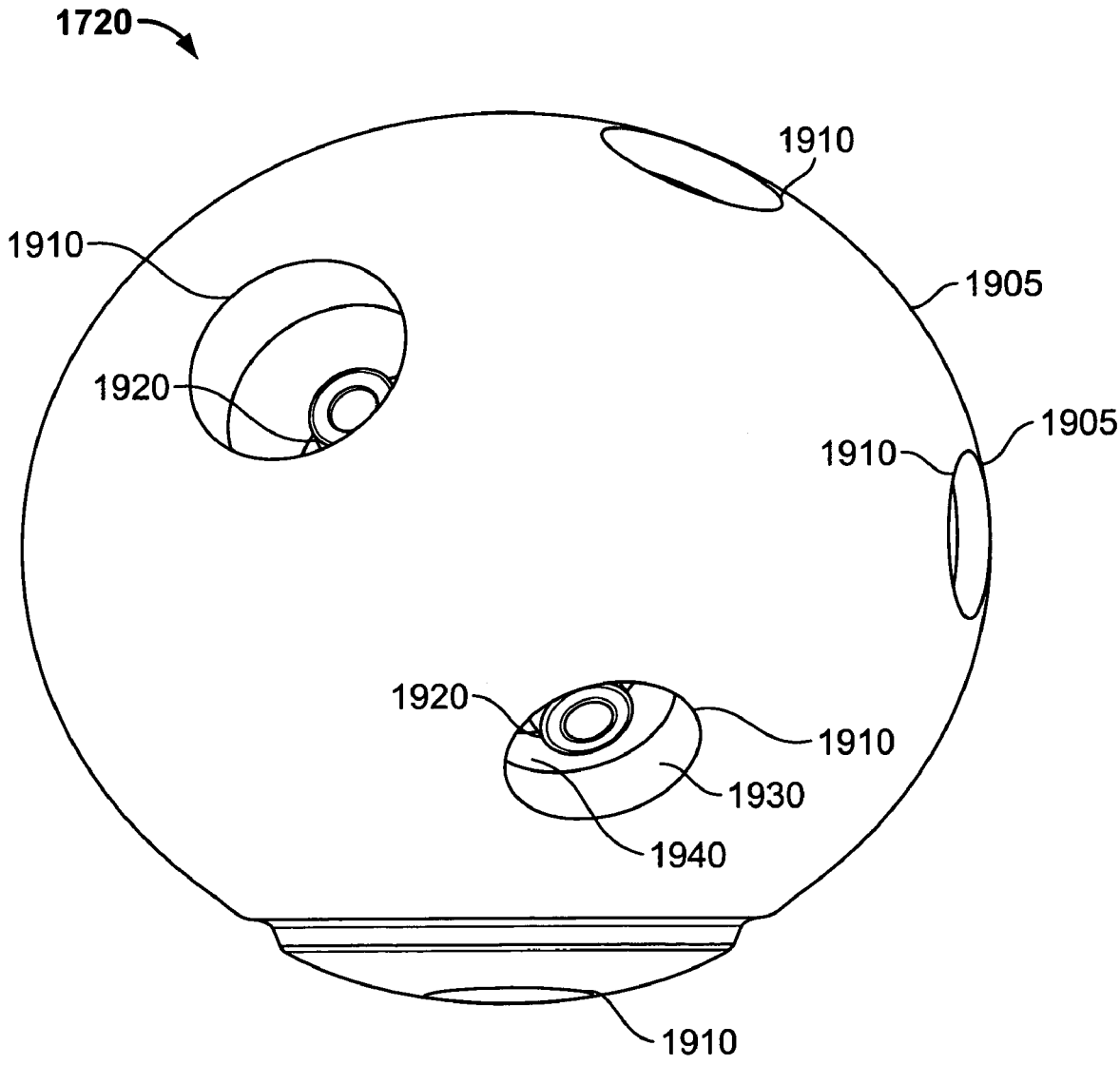
FIG. 19 is a perspective view of a connector of FIGS. 17 and 18.
Figure 20:
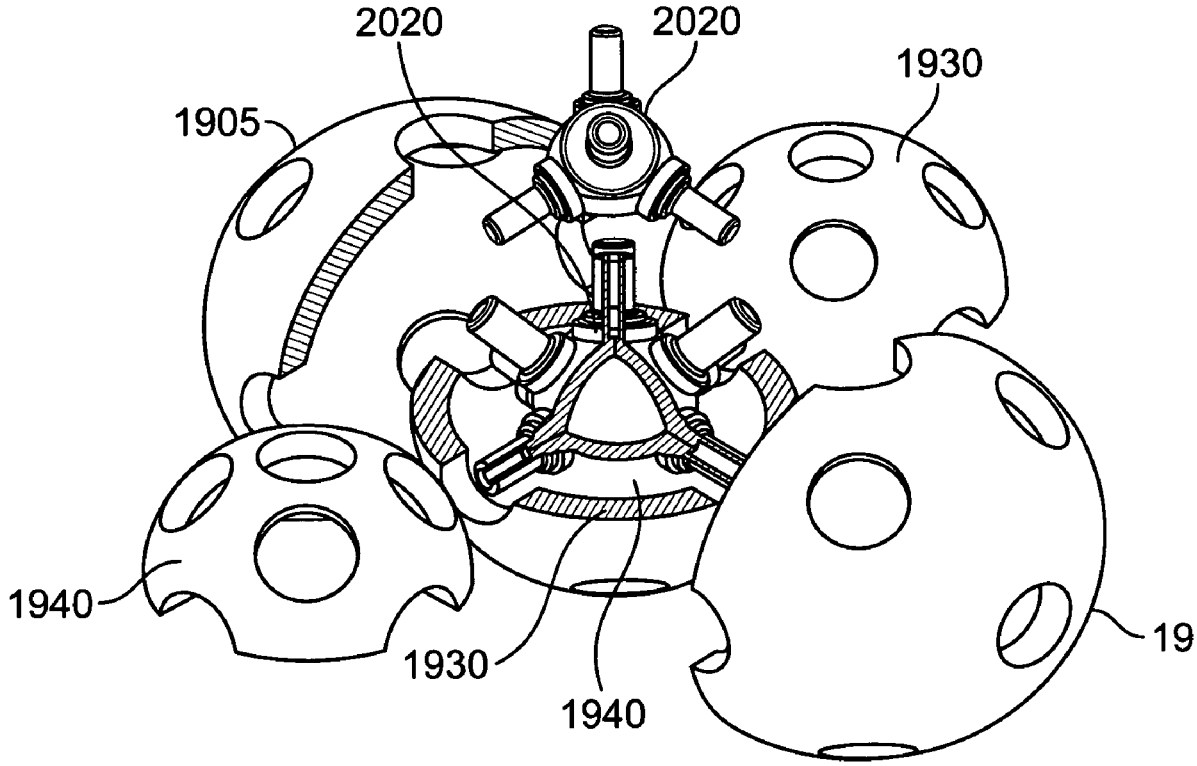
FIG. 20 is an interior view of the connector of FIG. 19.

FIGS. 19 and 20 show a perspective view and an interior view of connector 1720, respectively. Connector 1720 contains a plastic outer shell 1905 covering a metal shell 1930 (e.g., perimeter conductor 1830), which is separated from center pin system 1920 (e.g., center conductor 1820) by insulating shell 1940. Connecting holes 1910 are aligned holes in plastic outer shell 1905, metal insulating inner shell 1930, and insulating inner shell 1940 that expose center pin system 1920.

Connecting holes 1910 may be arranged in various configurations around connector 1720 as described above with respect to FIG. 18. In addition, although depicted in the figures as being circular, holes 1910 may be formed into various shapes to receive an end of element 1710. For example, an end of an element may be formed in the shape of a rectangle to be received by a rectangular connecting hole.

Center pin system 1920 is used to receive the coaxial connector or plug 1840 of element 1710. In particular, center pin system 1920 contains two or more center pin elements 2020, each pin 2020 exposed by connecting hole 1910 to receive an element 1710. Center pin system 1920 is not limited to a particular arrangement of pin elements 2020 or to a particular number of pin elements 2020.

Figure 21:
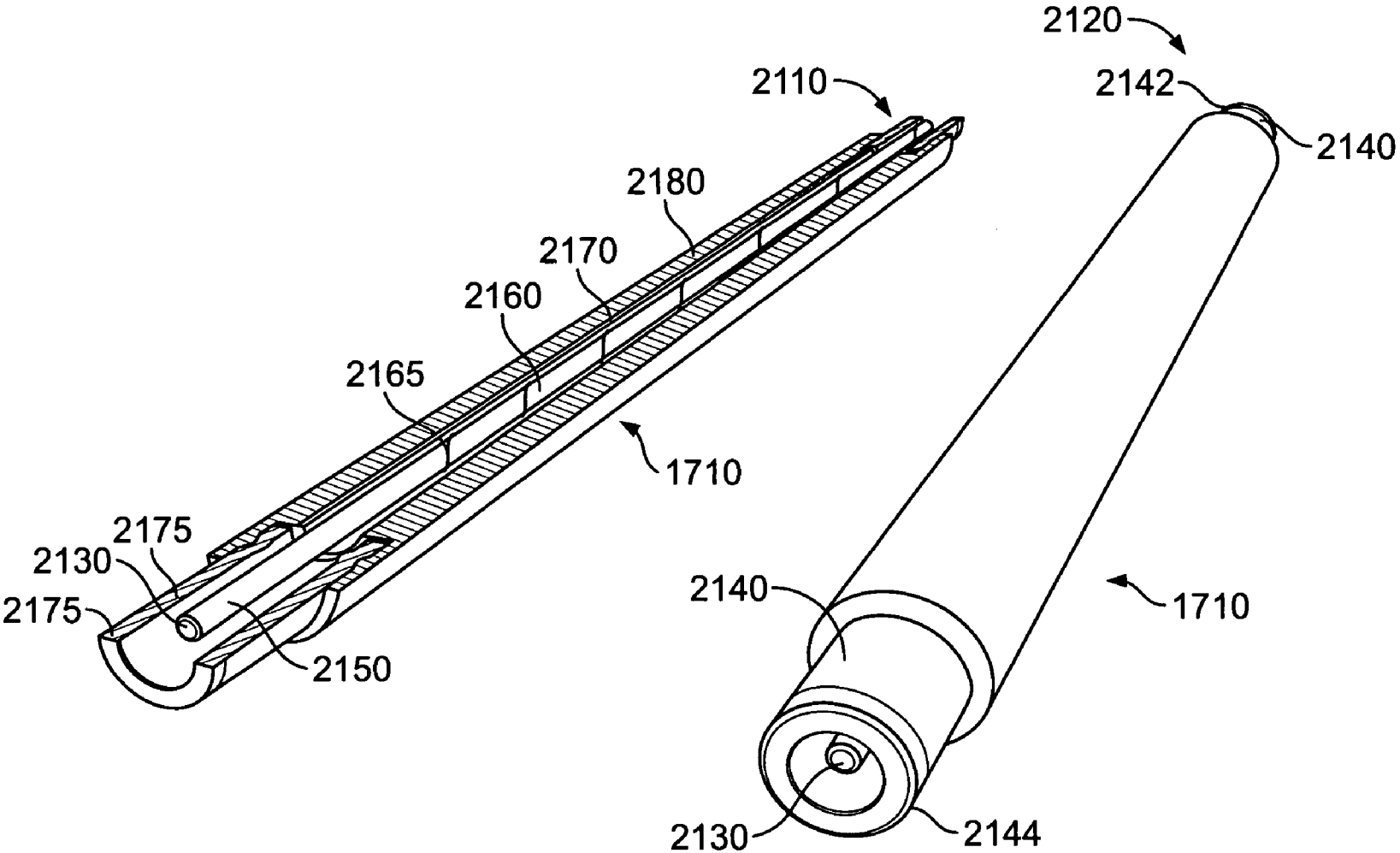
FIG. 21 is a perspective view and interior view of an element of FIGS. 17 and 18.

FIG. 21 shows a perspective view 2110 and interior view 2120 of element 1710 using an electro luminescent light source. Element 1710 is the building block of construction system 1700. Although an electro luminescent light source is shown in FIG. 21, the light source is not limited to any particular technology and could include LEDs, miniature incandescent light bulbs or any other electrically activated light source.

Element 1710 is depicted herein as a cylindrical tube enclosing a light source. However, element 1710 can be designed and built in any desired shape, depending on the nature of the model. Some examples of elements include components of a robot, organs of an insect and segments of abstract construction. Elements also may be designed in any one of the shapes described above with respect to the first through fourth embodiments. In a basic model set, elements are cylindrical tubes or any extruded shape with a constant or variable section. In yet another model set, elements include a variety of different shapes, colors and sizes.

Element 1710 includes a light source 2150 and coaxial connector or plug 1840. In a construction kit, various different colors may be used for light source 2150. Coaxial connector or plug 1840 is inserted into connector 1720. Power supplied at a first end 2142 is transmitted by element 1710 to a second end 2144. When linked to connector 1720, second end 2144 transfers power to connector 1720, which in turn conducts power to any other element linked to the connector.

Coaxial connector or plug 1840 contains a constant-positive coaxial center pin 2130 that addresses any potential polarity issues.

Because FIG. 21 depicts an electro-luminescent (EL) light source, light source 2150 includes a conductive core 2160 (in this case an extension of the coaxial center pin 2130), an exterior coil 2165, an EL coating 2170, a coaxial sleeve 2175 and a clear shell 2180. In this embodiment, power excites phosphors in the EL coating 2170 to produce light, as recognized by one of ordinary skill in the art.

If a condensed light source is used, a deflecting, reflecting or diffusing surface or surfaces will spread the light over the entire element. In some cases, the material of the element itself could be diffusing, such as a frosted translucent surface illuminated from within.

Figure 22:
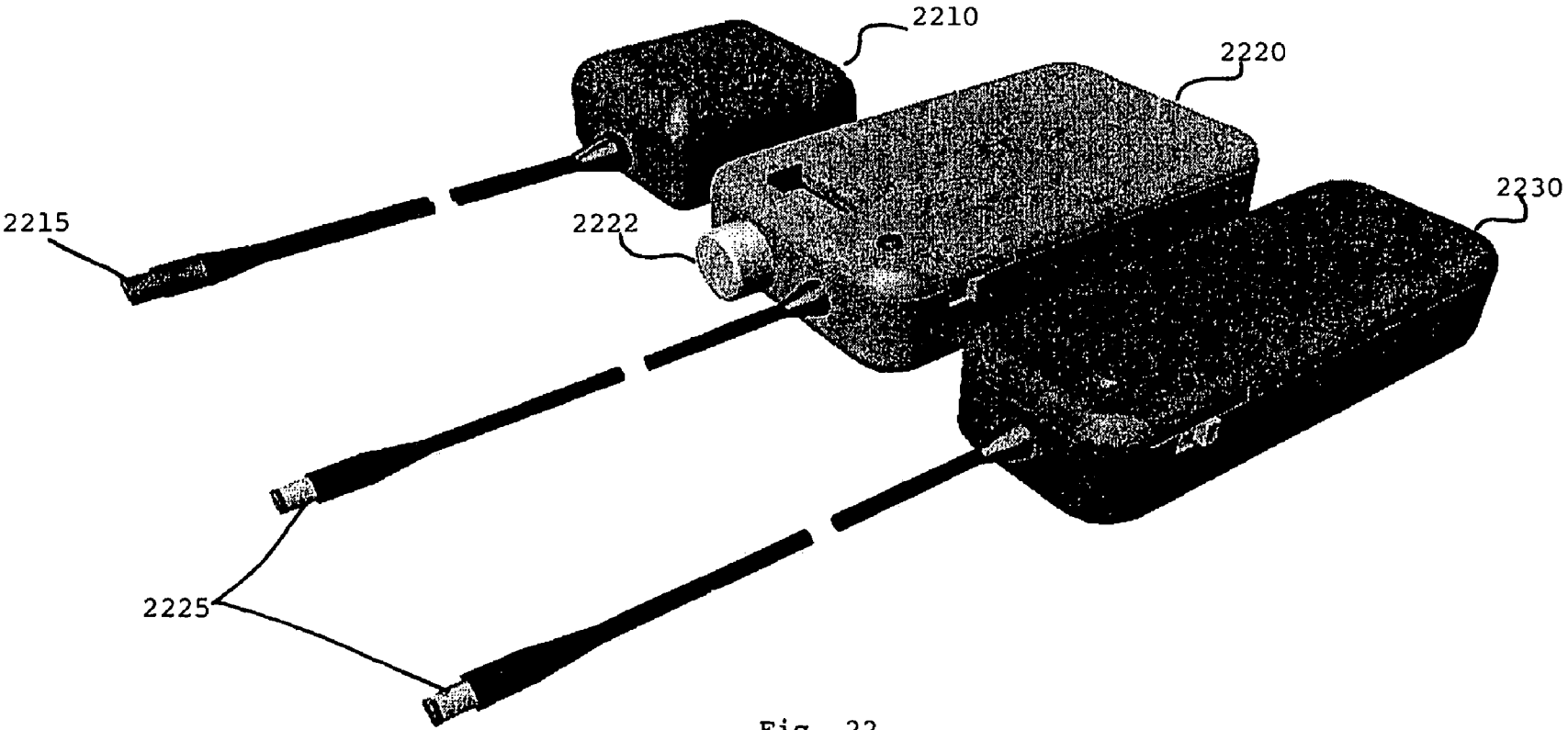
FIG. 22 is a view of various power sources for use with the elements and connectors of FIG. 17.

FIG. 22 shows a view of exemplary power source configurations for use with the elements and connectors of FIG. 17. In one embodiment, power source 2210 is plugged into device 2220, and device 2220 is plugged into connector 1720. In another embodiment, power source 2210 is plugged into device 2230, and device 2230 is plugged into connector 1720. In yet another embodiment (not shown), power source 2210 is plugged directly into connector 1720. In the latter embodiment, plug 2215 would be formed to fit into connector 1720, rather than a device 2220 or 2230.

Power source 2210 can include a DC source, an AC source or a high frequency source. Further, power source

2210 is selected based upon the requirements of the light source selected for element 1710. A DC source can include a DC regulated source using a wall plug and an AC/DC transformer. Alternatively, the DC source may include a battery pack. An AC source can include a transformer or a battery pack with oscillator. A high frequency source includes a battery pack with transformer and oscillator or a wall plug with a transformer and oscillator.

Each power source 2210 could be connected via plug 2215 to a device 2220 or 2230 to provide a power signal to activate a light source in a particular fashion. For example, the power signal could turn the light source on and off to achieve blinking, strobe or chase effects. Device 2220 includes a controller 2222 for adjusting the speed or frequency of the lights; whereas, device 2230 does not include such a controller. Device 2220 or 2230 connects to controller 1720 via plug 2225. In an alternative embodiment, device 2220 or 2230 could be integrated in the power supply 2220, rather than provided as an attachment to the system. In yet another embodiment, the power supply 2210 can connect directly to connector 1720 without an integrated or attached device 2220 or 2230.

In another embodiment of the invention, construction elements 1710 are connected also via connectors 1720 to construction members (not shown). Like construction elements 1710, construction members can be in any shape. However, unlike construction elements 1710, the construction members are not illuminated. Nonetheless, the construction members are conductive and transfer power from one end to another end, allowing a structure containing construction elements 1710 to remain illuminated when a power source is applied.

According to another embodiment of the invention, construction elements 1710 and connectors 1720 can include a ring of protrusions and cavities or ridges and grooves, as described in the above embodiments.

It will be understood that the embodiments of the present invention described herein are merely exemplary and that a person skilled in the art may make many variations and modifications without departing from the spirit and scope of the invention. All such variations and modifications, including those discussed above, are therefore intended to be included within the scope of the present invention.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A construction kit, comprising:

a plurality of illuminated elements, each illuminated element having a light source and being electrically conductive, a plurality of connectors for linking the plurality of illuminated elements mechanically and electrically to form an illuminated structure, each connector having at least two apertures and being electrically conductive, wherein each connector includes a center pin element containing two or more conductive pins for connecting the plurality of illuminated elements; and a power supply for supplying power to one connector of the plurality of connectors, wherein the power is transferred from the one connector to each of the plurality of illuminated elements and each of the remaining plurality of connectors, thereby illuminating the illuminated structure.

2. The construction kit of claim 1, wherein an element of the plurality of illuminated elements is linked to a connector of the plurality of connectors by inserting an end of the element into an aperture of the connector.

3. The construction kit of claim 1, wherein each connector comprises an insulating shell formed around the center pin element, a metal shell formed around the insulating shell, a plastic shell around the metal shell, and wherein the plastic shell, metal shell and insulating shell define aligned holes that expose each pin of the center pin element.

4. The construction kit of claim 1, wherein each connector is a sphere that links the plurality of illuminated elements at various angles.

5. The construction kit of claim 1, wherein the light source includes one of an electro-luminescent light, a light emitting diode and a miniature incandescent light bulb.

6. The construction kit of claim 1, wherein the light source further contains coaxial connector pins at each end of the element.

7. The construction kit of claim 1, further comprising a control circuit that illuminator with one of the plurality of elements a blinking, strobe and chase effect.

8. The construction kit of claim 1, wherein the plurality of elements blink sequentially.

9. The construction kit of claim 1, wherein the illuminated structure contains a plurality of different colors of light.

10. A construction kit, comprising:

a plurality of illuminated elements, each illuminated element having a light source and being electrically conductive.

a plurality of connectors for linking the plurality of illuminated elements mechanically and electrically to form an illuminated structure, each connector having at least two apertures and being electrically conductive; and a power supply for supplying power to one connector of the plurality of connectors, wherein the power is transferred from the one connector to each of the plurality of illuminated elements and each of the remaining plurality of connectors, thereby illuminating the illuminated structure, wherein an element of the plurality of illuminated elements is linked to a connector of the plurality of connectors by inserting an end of the element into an aperture of the connector, wherein the end of the element includes a first ring of protrusions and cavities and the aperture includes a second ring of protrusions and cavities that is complementary to the first ring.

11. A construction kit comprising: a plurality of construction modules, wherein each construction module includes an internal chamber, a light source disposed in the internal chamber, a first coaxial connector located on a first external side, a second coaxial connector complementary to the first coaxial connector located on a second external side, a first series of protrusions and cavities, the first series being formed on the first external side around the first coaxial connector, a second series of protrusion and cavities, the second series being complementary to the first series and being formed on the second external side around the second coaxial connector; and a power source for applying power to the plurality of construction modules, wherein the plurality of construction modules are linked mechanically and electrically by mating first coaxial connectors with second coaxial connectors such that power is applied to the plurality of construction modules.

12. The construction kit of claim 11, wherein at least one of the plurality of construction modules is in the shape of one of a cube, cylinder, pyramid, and prism.

13. The construction kit of claim 11, wherein at least one side of each construction module is made of one of translucent and transparent material.

14. The construction kit of claim 11, wherein the first series is a first circular ring of protrusions and cavities and the second series is a second circular ring with protrusions and cavities formed complementary to the first circular ring.

15. The construction kit of claim 11, wherein the first coaxial connector includes a first conductive ring and a first projection, the first projection being electrically conductive, having a magnetic surface of a first polarity, and being centrally disposed within the first conductive ring to extend outwardly from within the internal chamber, the second coaxial connector includes a second conductive ring and a second projection, the second projection being electrically conductive, having a magnetic surface of a second polarity, and being centrally disposed within the second conductive ring extending outwardly from within the interior chamber, a plurality of interior conductors located within the interior chamber to make the first conductive ring, the second conductive ring, the first projection, and the second projection electrically common, and the light source being illuminated by power received via at least one of the first connector and the second connector.

16. The construction kit of claim 11, wherein the first series comprises radially-extending ridges and channels and the second series comprises radially-extending ridges and channels that are formed complementary to the first series.

17. The construction kit of claim 11, wherein the plurality of construction modules includes at least one of a plurality of shapes and a plurality of different colors of light.

18. The construction kit of claim 11, wherein the power source comprises a power module in the shape of a cube having one of a first coaxial connector and a second coaxial connector on five sides and a power plug for connection to a power supply on a sixth side, and wherein the plurality of construction modules includes receiving modules in the shape of a cube having coaxial connectors on six sides.

19. The construction kit of claim 11, wherein the light source is at least one of an electro-luminescent light, a light emitting diode and a miniature incandescent light bulb.

* * * * *